US006425744B2

(12) United States Patent
Ozu et al.

(10) Patent No.: US 6,425,744 B2
(45) Date of Patent: Jul. 30, 2002

(54) HELICAL BLADE TYPE COMPRESSOR HAVING A HELICAL BLADE IN A STATIONARY CYLINDER

(75) Inventors: Masao Ozu, Fuji; Takayoshi Fujiwara; Tetsuo Fukuda, both of Yokohama, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/843,870

(22) Filed: Apr. 30, 2001

Related U.S. Application Data

(62) Division of application No. 09/177,374, filed on Oct. 23, 1998, now abandoned.

(30) Foreign Application Priority Data

Oct. 23, 1997 (JP) ..... 9-291222
Mar. 16, 1998 (JP) ..... 10-065692

(51) Int. Cl.[7] ..... F04C 18/00; F04C 23/00

(52) U.S. Cl. ..... 418/6; 418/55.1; 418/59; 418/220

(58) Field of Search ..... 418/6, 54, 55.1, 418/59, 220

(56) References Cited

U.S. PATENT DOCUMENTS 3,853,434 A 12/1974 Parsons ..... 418/220
5,139,394 A 8/1992 Aikawa et al. ..... 418/220
5,141,423 A 8/1992 Aikawa et al. ..... 418/220
6,074,184 A 6/2000 Imai ..... 418/220

FOREIGN PATENT DOCUMENTS

JP 2-19682 1/1990 ..... 418/220
JP 2-19683 1/1990 ..... 418/152
JP 3-96685 4/1991 ..... 418/220
JP 7-107391 11/1995
JP 10-196566 7/1998

*Primary Examiner*—John J. Vrablik
(74) *Attorney, Agent, or Firm*—Pillsbury Winthrop

(57) ABSTRACT

A helical blade type compressor is comprising a stationary cylindrical body, a closed-ended cylinder eccentrically arranged surrounding the cylindrical body, a helical compression section including a helical blade serving to divide the free space between the closed-ended cylinder and the cylindrical body into a plurality of compression chambers arranged in the axial direction of the cylindrical body, and a rotary shaft serving to eccentrically rotate the cylinder surrounding the cylindrical body, wherein a helical blade groove is formed on the circumferential surface of the cylindrical body and the helical blade is engaged with the helical groove such that an object fluid is moved in the axial direction of the cylindrical body so as to be compressed in accordance with the eccentric rotation of the cylinder.

18 Claims, 7 Drawing Sheets

HELICAL BLADE TYPE COMPRESSOR HAVING A HELICAL BLADE IN A STATIONARY CYLINDER

CROSS-REFERENCE TO RELATED APPLICATIONS

This application is a Divisional of U.S. patent application Ser. No. 09/177,374, filed Oct. 23, 1998, now abandoned, which is based upon and claims benefit of priority of Japanese Patent Applications No. Hei-9-291222, filed on Oct. 23, 1997, and No. Hei-10-065692, filed on Mar. 16, 1998, the contents of which are incorporated herein by reference.

BACKGROUND OF THE INVENTION

The present invention relates to a compressor constituting a refrigerating cycle of, for example, an air conditioner, particularly, to a helical blade type compressor for continuously compressing an object fluid, i.e., fluid to be compressed, in an axial direction of a cylinder.

A refrigerating cycle is incorporated in, for example, a domestic air conditioner, a refrigerator and a refrigerating show case. The refrigerating cycle is provided with a compressor for compressing a cooling medium. A reciprocating type compressor and a rotary compressor are popular as a compressor of this kind. In recent years, a helical blade type compressor employing a helical blade in the compressing mechanism portion is being developed.

The helical blade type compressor permits eliminating the defective sealing inherent in the conventional reciprocating type or rotary compressor and also permits improving the sealing properties with a relatively simple construction. In addition, manufacture and assembly of parts are facilitated.

The helical blade type compressor can be classified into two types. In one of the two types of the helical blade type compressor, a roller making an eccentric rotation is housed in a stationary cylinder. Also, a blade is engaged with a blade groove formed in the outer circumferential surface of the roller. Further, an object fluid, i.e., a cooling medium gas, is introduced into a compression chamber defined by the cylinder, the roller and the blade so as to compress the cooling medium gas.

FIG. 10 shows the construction of the conventional helical blade type compressor outlined above. As shown in the drawing, the compressor comprises a hermetic casing 1, a compressing mechanism section 2 housed in the hermetic casing 1, and a motor section 4 which is also housed in the hermetic casing 1. The compressing mechanism section 2, which is driven by the motor section 4 via a rotary shaft 3, includes a cylinder 5 fixed within the hermetic casing 1, a roller 6 eccentrically housed in the cylinder 5, and a helical blade 7 interposed between the roller 6 and the cylinder 5. A plurality of compression chambers 8 are defined by the helical blade 7 between the cylinder 5 and the roller 6 so as to extend in the axial direction of the cylinder 5.

The helical blade 7 is wound about a helical blade groove 7*a* formed in the outer circumferential surface of the roller 6 and is hermetically brought into contact with the inner circumferential surface of the cylinder 5. Also, the roller 6 is mounted to a crank portion 3*a* of the rotary shaft 3. The rotary shaft 3, which constitutes the output shaft of the motor section 4, is rotated in accordance with driving of the motor section 4, with the result that the roller 6 mounted to the crank portion 3 of the rotary shaft 3 is eccentrically rotated about the rotary shaft 3.

In the blade supporting mechanism in which the helical blade 7 is engaged with the blade groove 7*a* formed in the outer circumferential surface of the roller 6, the roller 6 is eccentrically rotated within the cylinder 5. In this mechanism, a revolution preventing mechanism 9 is mounted in order to prevent the roller 6 from being revolved about its own axis and to permit the roller 6 to be eccentrically rotated about the rotary shaft 3. An Oldham ring or the like is used as the revolution preventing mechanism.

In the other type of the conventional helical blade type compressor, a roller is eccentrically arranged within a rotating cylinder. In this case, a helical blade is engaged with a helical blade groove formed in the outer circumferential surface of the roller. The roller is rotated in synchronism with rotation of the cylinder, and a cooling medium gas is introduced into a compression chamber defined among the cylinder, the roller and the blade so as to be compressed in the compression chamber.

However, any of the two types of the conventional helical blade type compressor described above gives rise to problems. Specifically, in the former type, a blade groove with which the blade is engaged is formed on the outer circumferential surface of the roller, leading to a large thickness of the roller wall and, thus, to a large rotary mass. It follows that a large vibration is generated during rotation of the roller about the rotary shaft.

Further, since the roller 6 is rotated about the rotary shaft 3 with the helical blade 7 engaged with the blade groove 7*a* formed on the outer circumferential surface of the roller, the revolution preventing mechanism 9 is required for preventing the roller 6 from being revolved about its own axis. Therefore, the number of parts is increased and the sliding member is also increased. As a result, the compressor function is impaired and detrimental effects are given to the compressor performance. Further, the manufacturing cost of the compressor is increased. What should also be noted is that the assembling structure of the compressing section 2 is made complex, making it laborious to assemble the compression section 2.

In the latter type, a blade groove is also formed on the outer circumferential surface of the roller which is rotated in synchronism with rotation of the cylinder, leading to a thick roller wall and, thus, to an increased rotary mass of the roller. It follows that a large vibration is generated during rotation of the roller.

Further, the helical blade type compressor is required to compress a large volume of an object fluid. If the compressor is enlarged for compressing a large volume of the object fluid, the rotary mass and vibration of the roller are further increased, making it necessary to use a large counter balancer for suppressing the vibration. In this case, a problem is generated in respect of the mounting space of the large counter balancer. In addition, if the roller is rotated at a high speed by using an inverter, the rotary shaft is bent so as to increase the vibration, and the bearing is abraded and damaged in an early stage.

Under the circumstances, it is required to decrease the wall thickness of the roller in any type of the helical blade type compressor so as to diminish the rotary mass. However, it is impossible to meet the requirement as far as a blade groove is formed on the outer circumferential surface of the roller.

BRIEF SUMMARY OF THE INVENTION

A first object of the present invention is to provide a helical blade type compressor which permits suppressing the vibration by diminishing the eccentric mass of a rotary body.

A second object of the present invention is to provide a helical blade type compressor which permits decreasing the rotary mass of the rotary body so as to increase the volume of the object fluid without impairing the manufacturing properties of the compressor.

A third object of the present invention is to provide a helical blade type compressor which permits decreasing the rotary mass of the rotary body so as to increase the volume of the object fluid and also permits increasing the compression capacity.

Further, a fourth object of the present invention is to provide a helical blade type compressor which permits simplifying the assembling structure of the helical compression section so as to facilitate the assembly of the compressor.

According to a first aspect of the present invention, there is provided a helical blade type compressor, comprising a stationary cylinder, a roller eccentrically arranged within the cylinder, a helical compression section including a helical blade serving to divide the free space between the roller and the cylinder into a plurality of compression chambers arranged in the axial direction of the cylinder, and a rotary shaft serving to eccentrically rotate the roller within the cylinder, wherein a helical blade groove is formed on the inner circumferential surface of the cylinder and the helical blade is engaged with the helical groove such that an object fluid is moved in the axial direction of the cylinder so as to be compressed in accordance with the eccentric rotation of the roller.

According to a second aspect of the present invention, there is provided a helical blade type compressor, comprising a stationary cylindrical body, a cylinder closed at one end, open at the other end, and arranged to surround the outer circumferential surface of the cylindrical body, and a helical blade interposed between the outer circumferential surface of the cylindrical body and the inner circumferential surface of the cylinder, and a compression chamber defined among the outer circumferential surface of the cylindrical body, the inner circumferential surface of the cylinder, and the helical blade, wherein an object fluid is guided into the compression chamber so as to be compressed in accordance with eccentric rotation of the cylinder relative to the cylindrical body.

According to a third aspect of the present invention, there is provided a helical blade type compressor, comprising a stationary cylindrical body, a movable cylinder closed at one end, open at the other end, and arranged to surround the outer circumferential surface of the cylindrical body, stationary cylinder closed at one end, open at the other end, and arranged to surround the outer circumferential surface of the movable cylinder, a helical inner blade interposed between the outer circumferential surface of the cylindrical body and the inner circumferential surface of the movable cylinder, an inner compression chamber defined among the outer circumferential surface of the cylindrical body, the inner circumferential surface of the movable cylinder and the inner blade, a helical outer blade interposed between the outer circumferential surface of the movable cylinder and the inner circumferential surface of the stationary cylinder, and an outer compression chamber defined among the outer circumferential surface of the movable cylinder, the inner circumferential surface of the stationary cylinder, and the helical outer blade, wherein an object fluid is guided into each of the inner compression chamber and the outer compression chamber so as to be compressed in accordance with the eccentric rotation of the movable cylinder relative to the cylindrical body.

According to a fourth aspect of the present invention, there is provided a helical blade type compressor, comprising a first cylindrical member, a second cylindrical member arranged to surround the first cylindrical member, the second cylindrical member being eccentric relative to the first cylindrical member, driving means for relatively driving the first cylindrical member and the second cylindrical member, and a helical blade interposed between the first cylindrical member and the second cylindrical member, wherein one of the first cylindrical member and the second cylindrical member is made stationary and the other is made rotatable, and the helical blade is detachably engaged with a blade groove formed on the stationary cylindrical member, such that an object fluid is moved in the axial direction of each of the cylindrical members so as to be compressed in accordance with the eccentric rotation of the rotatable cylindrical member.

In the first aspect of the present invention, the diameter of the roller arranged within the stationary cylinder can be diminished so as to decrease the rotary mass. At the same time, a mechanism for preventing the roller from being revolved about its own axis is not required so as to decrease the number of parts required. As a result, the construction of the helical compressing section can be simplified so as to facilitate the assembly of the compressor.

In the second aspect of the present invention, the wall thickness of the rotatable cylinder can be decreased, leading to a decreased rotary mass. As a result, the compression capacity can be increased, and the compressor can be manufactured without difficulty.

In the third aspect of the present invention, the rotary mass of the rotatable member can be decreased so as to increase the compression capacity. Also, the compression capacity can be further increased.by using two cylinders.

Further, in the fourth aspect of the present invention, the wall thickness of the member which makes an eccentric rotation can be decreased so as to diminish the rotary mass. As a result, occurrence of vibration can be suppressed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The preferred embodiments of the present invention will be described with reference to the accompanying drawings.

Figure 1:
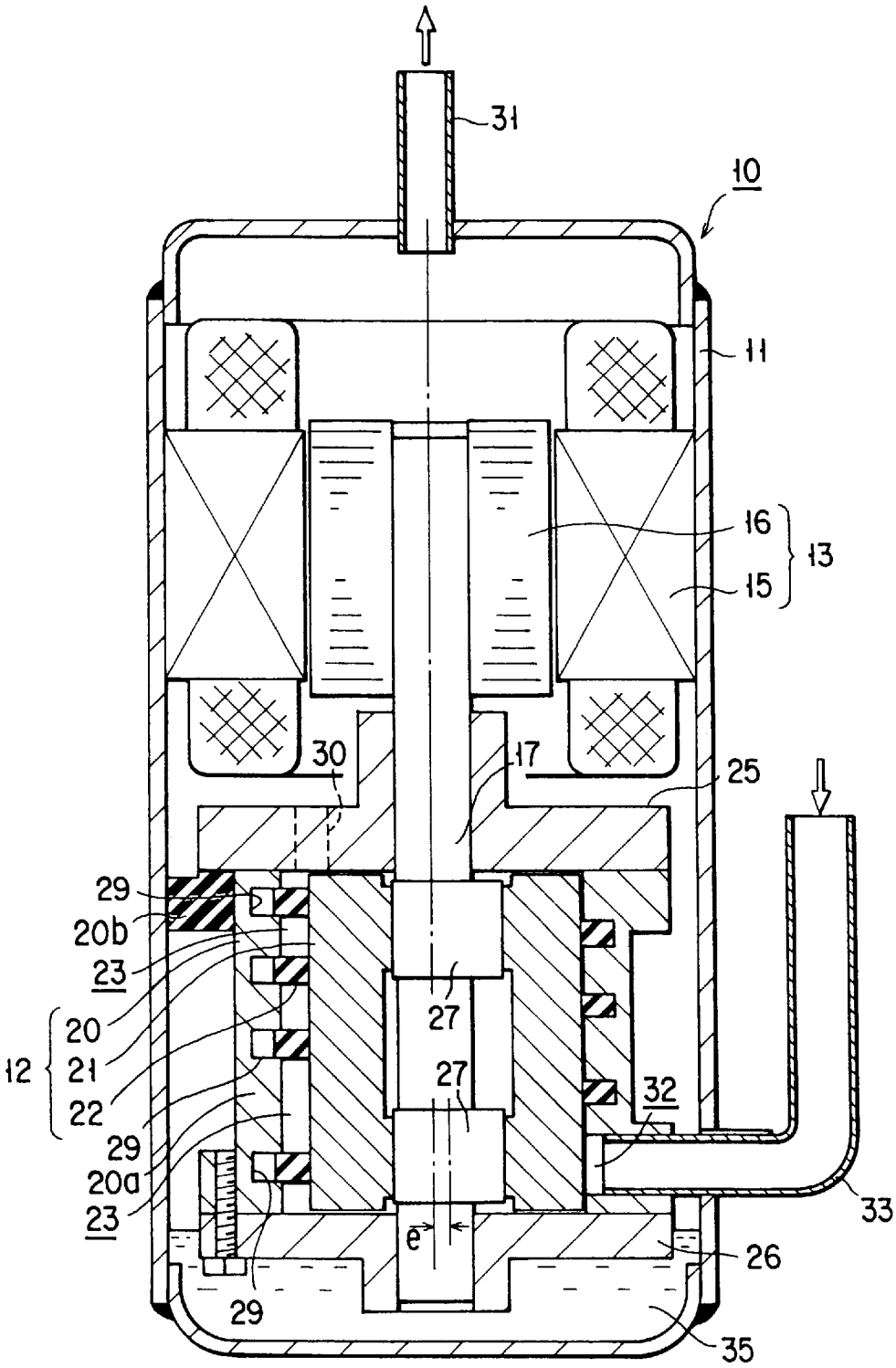
FIG. 1 is a vertical cross sectional view showing a helical blade type compressor according to a first embodiment of the present invention.

Specifically, FIG. 1 is a vertical cross sectional view showing a vertical helical blade type compressor 10 according to a first embodiment of the present invention. As shown in the drawing, the vertical helical blade type compressor 10 comprises a cylindrical hermetic case 11. A helical compressing section 12 and a motor section 13 are housed in the case 11.

The motor section 13 consists of a motor stator 15 pushed into and fixed within the hermetic case 11 and a motor rotor 16 rotatably housed within the motor stator 15. The motor rotor 16 is integrally mounted to a rotary shaft 17, which is an output shaft of the motor section 13. Upon supply of an electric power, the motor section 13 is driven so as to rotate the motor rotor 16.

On the other hand, the compressing section 12 comprises a cylinder 20 fixed to the hermetic case 11, a roller 21 which is rotated and eccentrically housed within the cylinder 20, and a helical blade 22 interposed between the roller 21 and the cylinder 20. The free space between the cylinder 20 and the roller 21 is divided by the helical blade 22 into a plurality of compression chambers 23 arranged in the axial direction of the cylinder 20.

The cylinder 20 comprises a cylinder block 20*a* and is provided with a flange-like or bracket-like mounting section 20*b* extending outward from the cylinder block 20*a* such that the mounting section 20*b* abuts against the inner wall of the hermetic case 11 so as to be fixed. A main bearing 25 and an auxiliary bearing 26 are fixed to close the upper and lower end portions of the cylinder 20. It is possible to form any one of the main bearing 25 and the auxiliary bearing 26 integral with the cylinder 20.

The rotary shaft 17 is rotatably supported by these main bearing 25 and auxiliary bearing 26. A crank section 27 of the rotary shaft 17 is formed between the bearings 25 and 26, and the roller 21 is mounted to the crank section 27 of the rotary shaft 17. At least one crank section 27 is mounted between the bearings 25 and 26. Practically, a pair of crank sections 27 are formed apart from each other in the axial direction of the rotary shaft 17 such that one of the paired crank sections is positioned in the vicinity of the main bearing 25, with the other crank section being positioned in the vicinity of the auxiliary bearing 26. These paired crank sections 27 permit the roller 21 to make an eccentric rotation with a high stability.

The roller 21 is eccentrically mounted with an eccentricity of "e" to the crank section 27 of the rotary shaft 17 so as to permit the roller 21 to be brought into contact partially with the inner circumferential surface of the cylinder 20. On the other hand, a helical blade groove 29 is formed on the inner circumferential surface of the cylinder 20. The blade groove 29 is formed, for example, substantially rectangular in cross section, and the pitch of the blade groove 29 is gradually diminished in the axial direction of the cylinder 20.

The helical blade 22 is engaged with the blade groove 29 formed on the inner circumferential surface of the cylinder 20. The pitch of the helical blade 22 is also diminished in the axial direction of the cylinder 20 from one end portion toward the other end portion, like the pitch of the blade groove 29. The helical blade 22 is brought into a hermetic contact with the outer surface of the cylindrical roller 21. Also, the cross sectional shape of the helical blade 22 is complementary with that of the blade groove 29 and, thus, is substantially rectangular.

In order to permit the helical blade 22 to be slid smoothly into and out of the blade groove 29 formed on the inner circumferential surface of the cylinder 20 in accordance with the eccentric rotation of the roller 21, it is possible for the outer corner portion of the helical blade 22 to be made roundish. It is also possible for the inner corner portion of the helical blade 22 to be made roundish in order to permit the helical blade 22 to be smoothly and hermetically brought into contact with the outer circumferential surface of the roller 21.

The helical blade 22 is formed of an elastic material, a plastic material, a resin material such as Teflon or a fluoroplastic material. Also, in order to permit the helical blade 22 to be slid smoothly within the blade groove 29, it is possible for the material of the helical blade 22 such as a plastic material, a fluorine-containing resin or a fluoroplastic material to be impregnated in advance with an oil. In this case, the impregnated oil performs a lubricating function.

As described previously, the free space between the cylinder 20 and the roller 21 is partitioned by the helical blade 22 into a plurality of compression chambers 23 which are shaped helical and arranged in the axial direction of the cylinder 20. These compression chambers 23 are continuously moved upward from the side of the auxiliary bearing 26 toward the main bearing 25 in accordance with the eccentric rotation of the roller 21, with the result that the object fluid, i.e., a cooling medium, contained in the compression chamber 23 is gradually compressed.

The compression chamber 23 on the side of the auxiliary bearing 26 has a low inner pressure. In accordance with the eccentric rotation of the roller 21, the compression chamber 23 is helically moved toward the main bearing 25 in the axial direction of the cylinder 20. During the helical movement, the volume of the compression chamber 23 is gradually diminished so as to compress the cooling medium contained in the compression chamber 23. In other words, the compression chamber on the side of the main bearing 25 has a high inner pressure. The compressed cooling medium within the compression chamber 23 on the side of the main bearing 25 is released through a discharge port 30 of the main bearing 25 into the hermetic case 11. The cooling medium discharged into the hermetic vessel 11 flows upward through the clearance of the motor section 13 so as to be discharged to the outside of the hermetic case 11 through a discharge pipe 31.

On the other hand, an inlet port 32 is formed in the cylinder 20 on the side of the auxiliary bearing 26, and a suction pipe 33 is connected to the inlet port 32. The suction pipe 33 hermetically extends through the hermetic case 11 so as to be guided into the cylinder 20, and the inlet port 32 of the cylinder 20 is held open.

Incidentally, a reference numeral 35 denotes a refrigerating oil stored in a bottom portion of the hermetic case 11 as a lubricating oil.

The vertical helical blade type compressor 10 of the construction described above is operated as follows.

In the first step, an electric power is supplied to the motor section 13 of the helical blade type compressor 10 so as to start operation of the motor section 13 and, thus, to rotate the motor rotor 16. The rotating force of the motor rotor 16 is transmitted through the rotary shaft 17 to the crank portion 27 so as to permit the roller 21 to make an eccentric rotation with an eccentricity of "e". During the eccentric rotation, the roller 21 slides along the inner circumferential surface of the cylinder 20 while making revolution about its own axis.

During the eccentric rotation of the roller 21, the compression chambers 23 formed between the cylinder 20 and the roller 21 by the presence of the helical blade 22 are helically moved upward in the axial direction of the cylinder 20 and, at the same time, the volumes of these compression chambers 23 are gradually diminished. Naturally, the cooling medium flowing into the compression chamber 23 positioned on the side of the auxiliary bearing 26 through the suction pipe 33 is gradually and continuously compressed to have a high pressure such that the compressed cooling medium of the high pressure is finally discharged from the compression chamber 23 positioned on the side of the main bearing 25 into the hermetic case 11. The cooling medium discharged into the hermetic case 11 flows upward through the clearance of the motor section 13 so as to be discharged to the outside of the hermetic case 11 through the discharge pipe 31 mounted to the top portion of the hermetic case 11. It is not absolutely necessary to mount the discharge pipe 31 to the top portion of the hermetic case 11. In other words, the discharge pipe 31 can be mounted at various portions of the hermetic case 11.

In the helical blade type compressor 10 of the present invention, the helical blade groove 29 is formed in the inner circumferential surface of the cylinder 20, making it unnecessary to form a blade groove on the outer circumferential surface of the roller 21. This makes it possible to diminish the wall thickness of the roller 21 except the sliding portion along the crank section 27 of the rotary shaft 17 so as to decrease the rotary mass of the roller 21. Also, since the blade groove 29 is formed on the inner circumferential surface of the cylinder 20, the blade groove 29 can be enlarged, and the helical blade 22 can be engaged with the blade groove 29 by utilizing the blade compression force. It follows that the helical blade 22 can be mounted easily.

It should also be noted that the blade groove 29 formed in the inner circumferential surface of the cylinder is equal in pitch to the helical blade 22 and is complementary to the helical blade 22 in the cross sectional shape, which is substantially rectangular. It follows that the helical blade 22 can be slidably housed stably within the helical blade groove 29 formed in the inner circumferential surface of the cylinder 20. Further, since the pitch of each of these helical blade 29 and the blade groove 29 is gradually diminished in the axial direction of the cylinder 20, the compression chambers 23 formed between the cylinder 20 and the roller 21 are allowed to perform the function of compressing the cooling medium housed in the compression chamber 23. Since the volume of the compression chamber 23 noted above is gradually diminished in accordance with the eccentric rotation of the roller 21, the object fluid of cooling medium can be compressed smoothly and continuously.

The helical blade 22 is in contact with the outer surface of the cylindrical roller 21. However, since the inner edge alone of the helical blade 22 is in contact with the outer surface of the roller 21, the contact area is small. In addition, since the roller 21 is mounted to the crank section 27 of the rotary shaft 17, the roller 21 makes an eccentric rotation in accordance with rotation of the rotary shaft 17. Also, the roller 21 is partially in contact with the inner circumferential surface of the cylinder 20. Since the roller 21 makes an eccentric rotation under this condition, the eccentric rotation of the roller 21 is substantially equal to the eccentric rotation of the piston roller of the rotary compressor. It follows that the roller 21 makes an eccentric rotation while making revolution about its own axis. It should be noted, however, that the contact area between the roller 21 and the helical blade 22 is small. In addition, a relative rotary sliding is permitted between the roller 21 and the helical blade 22. It follows that the revolution of the roller 21 about its own axis need not be regulated, making it unnecessary to provide a mechanism for preventing the revolution of the roller 21 about its own axis.

In the embodiment described above, the technical idea of the present invention is applied to a vertical helical blade type compressor. However, the technical idea of the present invention can also be applied similarly to a lateral helical blade type compressor.

Also, in the embodiment described above, a main bearing and an auxiliary bearing are mounted to the compressing section which is incorporated in the helical blade type compressor. However, the auxiliary bearing can be omitted such that the rotary shaft is supported by the main bearing alone. Further, the main bearing can be formed integral with the cylinder.

What should also be noted is that the outer diameter of each of the main bearing and the cylinder can be made smaller than the inner diameter of the winding of the motor stator included in the motor section such that the main bearing and the cylinder are partially housed in the winding of the motor stator included in the motor section. In this case, the motor section is partially overlapped with the helical compressing section so as to make the helical blade type compressor small and compact.

Figure 2:
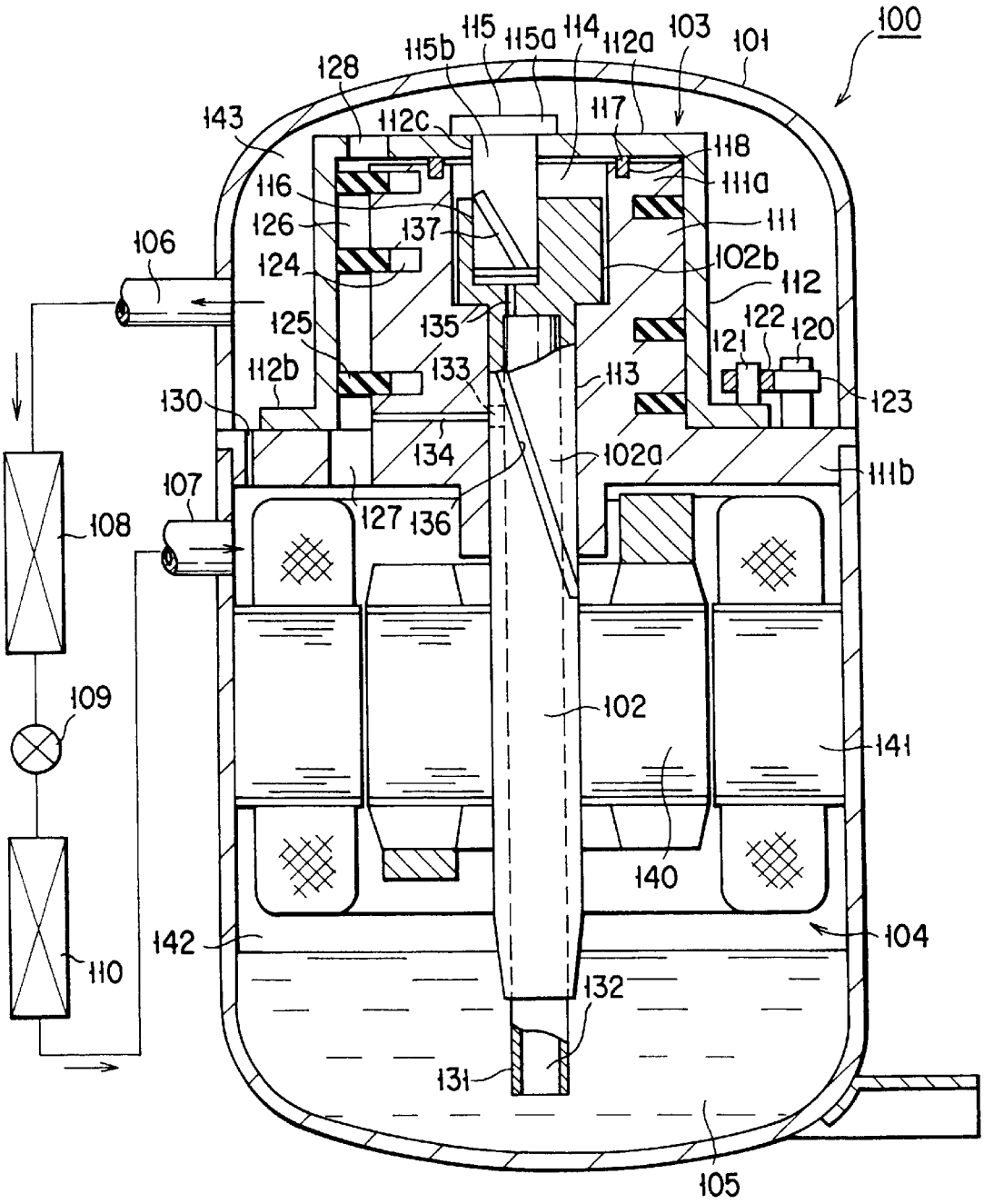
FIG. 2 is a vertical cross sectional view showing a helical blade type compressor according to a second embodiment of the present invention.

Let us describe a helical blade type compressor 100 according to a second embodiment of the present invention with reference to FIG. 2. As shown in the drawing, the helical blade type compressor 100 comprises a hermetic case 101. A compressing section 103 and a motor section 104, which are joined to each other via a rotary shaft 102, are housed in the hermetic case 101.

In this embodiment, the compressing section 103 and the motor section 104 are arranged in the upper and lower portions, respectively, of the hermetic case 101. The rotary shaft 102 extends downward through the motor section 104 such that the lower end portion of the rotary shaft 104 is dipped in a lubricant housed in a lubricant reservoir 105 formed in a bottom portion of the hermetic case 101.

A discharge coolant pipe 106 is connected to an upper portion of the hermetic case 101, and a suction coolant pipe 107 is connected to an intermediate portion of the hermetic case 101. Further, a condenser 108, an expansion valve 109 and an evaporator 110 are interposed in the order mentioned between these discharge coolant pipe 106 and suction coolant pipe 107 so as to form a refrigerating cycle of, for example, an air conditioner.

Let us describe in detail the compressing section 103. Specifically, a reference numeral 111 denotes a cylindrical body having a small diameter portion 111*a* formed in an upper portion and a large diameter portion (or frame) 111*b* formed in a lower portion. The circumferential surface of the small diameter portion 111*a* and the upper end of the cylindrical body 111 are covered with a cylinder 112 which is described herein later. The frame 111*b* of the cylindrical body 111 is in the form of a disk having a diameter substantially equal to the inner diameter of the hermetic case 101 and is engaged with the inner circumferential surface of the hermetic case 101. Under this condition, the frame 111*b* is welded from the outer circumferential surface of the hermetic case 101 to the hermetic case 101. In other words, the inner space of the hermetic case 101 is partitioned by the frame 111*b* into an upper chamber and a lower chamber.

The lower surface of the frame 111*b* partly projects downward, and a pivotally supporting hole 113 is formed along the axis of the cylindrical body 111 including the projecting portion. A main shaft portion 102*a* of the rotary shaft 102 is inserted into and rotatably pivoted within the pivotally supporting hole 113.

An eccentric bearing section 114 having a downwardly projecting outer peripheral portion is mounted at the upper end of the pivotally supporting hole 113. A crank section 102*b* having an axis deviant from the axis of the main shaft section 102*a* is integrally mounted to the upper end of the main shaft section 102*a* of the rotary shaft so as to be pivotally supported by the eccentric bearing section 114.

The cylinder 112 is open at the lower end and has a substantially hat-shaped cross section. The depth of the cylinder 112, i.e., the vertical distance between the closed upper end surface 112*a* and the surface of a lower flange portion 112*b*, is slightly larger than the height of the small diameter portion 111*a* of the cylindrical body. It follows that the lower surface of the flange portion 112*b* is disposed on the upper surface of the frame 111*b* of the cylindrical body under the condition that the small diameter portion 111*a* of the cylindrical body is covered with the cylinder 112.

A mounting hole 112*c* with which a drive shaft 115 is engaged is formed in a central portion of a closed upper surface 112*a* of the cylinder 112. The drive shaft 115 includes a flange portion 115*a* formed at the upper end and a shaft portion 115*b*. The flange portion 115*a* is disposed on the upper closed surface 112*a* of the cylinder 112. On the other hand, the shaft portion 115*b* which is integral with the flange portion 115*a* projects downward into the cylinder 112. In other words, the drive shaft 115 hangs from the closed upper surface 112*a* of the cylinder 112.

The shaft portion 115*b* of the drive shaft 115 is rotatably pivoted within a crank hole section 116 extending downward from the upper surface of the crank section 102*b* of the rotary shaft. It follows that, if the rotary shaft 102 pivotally supported by the cylindrical body 111 is rotated, the cylinder 112 makes an eccentric rotation via the crank section 102 of the rotary shaft and the drive shaft 115. Also, since the lower surface of the cylinder flange portion 112*b* is positioned on the cylindrical frame 111*b*, the lower surface of the cylinder flange portion 112*b* acts as a thrust surface so as to slide along the frame 111*b*.

A seal ring groove 118 with which is engaged a seal ring 117 is formed along the outer periphery of the eccentric bearing section 114 on the upper surface of the small diameter portion 111*a* of the cylindrical body. The seal ring 117 projects upward from the upper surface of the small diameter portion of the cylindrical body so as to be brought into contact with the cylinder closing surface 112*a* so as to achieve a desired sealing.

When the cylinder 112 makes an eccentric rotation, a pin 120 is erected on the portion of the upper surface of the frame 111*b* of the cylindrical body in which the pin 120 is not brought into contact with the cylinder flange portion 112*b*. On the other hand, another pin 121 is also erected in the vicinity of the pin 120 erected on the cylinder flange portion 112*b*. An arm 122 is stretched between the pin 120 on the frame 111*b* of the cylindrical body 111 and the pin 121 on the flange portion 112*b*. The arm 122 has an elongated hole formed at one end portion. The pin 120 is connected to the arm 122 such that it can be freely reciprocated and swung. The pin 120 is swingably connected to the other end portion of the arm 122. That is, the distance between the pins 120 and 121 can be varied within a predetermined range, and the relative angle between those pins can be varied within a predetermined range.

Therefore, even if the cylinder 112 is given an eccentric rotation force, and can revolve around the rotary shaft 102, the cylinder 112 is prevented from rotating about its own rotation axis since pins 120 and 121 are coupled to each other by the arm 122. As such, the cylinder 112 is allowed to make an eccentric rotation in accordance with rotation of the rotary shaft 102, while inhibiting the revolution of the cylinder 112 about its own axis.

A helical groove 124 is formed on the outer circumferential surface of the small diameter portion of the cylindrical body such that the pitch of the helical groove is gradually diminished from the lower portion toward the upper portion. A helical blade 125 is slidably engaged with or disengaged from the blade groove 124.

The blade 125 is formed of, for example, a fluorine-containing resin and has a very smooth surface. The inner diameter of the blade 125 is larger than the diameter of the small diameter portion 111*a* of the cylindrical body. The blade 125 is engaged with the blade groove 124 under the condition that the diameter of the blade 125 is forcedly diminished. As a result, the outer circumferential surface of the blade 125 is kept elastically pressed against the inner circumferential surface of the cylinder 112 under the condition that the blade 125 is incorporated together with the small diameter portion 111*a* of the cylindrical body in the cylinder 112.

The contact region between the inner circumferential surface of the cylinder 112 and the outer circumferential surface of the small diameter portion 111*a* of the cylindrical body is gradually moved in the circumferential direction of the small diameter portion 111*a* of the cylindrical body in accordance with the eccentric rotation of the cylinder 112. The blade 125 is inserted into the blade groove 124 in the region where the inner circumferential surface of the cylinder 112 is in contact with the outer circumferential surface of the small diameter portion 111*a* of the cylindrical body. On the other hand, the outer circumferential surface of the blade 125 in the opposite region forms a surface completely equal to the circumferential surface of the small diameter portion 111*a* of the cylindrical body.

If the contact region has passed through, the blade 125 projects out of the blade groove 124 in accordance with the distance from the contact region, and the length of projection of the blade 125 reaches a maximum at the point remote by an angular distance of 180° from the contact region. Then, the contact region approaches again to the particular position so as to repeat the sliding motion of the blade 125 into and out of the blade groove 124 described above.

When it comes to a cross section in a radial direction of the small diameter portion 111*a* of the cylindrical body and the cylinder 112, the small diameter portion 111*a* of the cylindrical body is eccentrically covered with the cylinder 112 such that the inner circumferential surface of the cylinder 112 is partially in contact with the outer circumferential surface of the small diameter portion 111*a* of the cylindrical body. It follows that a crescent-shaped free space is formed between the outer circumferential surface of the small diameter portion 111*a* of the cylindrical body and the inner circumferential surface of the cylinder 112.

If viewed in the axial direction, the crescent-shaped free space between the outer circumferential surface of the small diameter portion 111*a* of the cylindrical body and the inner circumferential surface of the cylinder 112 is partitioned by the helical blade 125 into a plurality of consecutive free spaces because the helical blade 125 is partially engaged with the helical blade groove 125 and the inner circumferential surface of the cylinder 112 is slidably in contact partially with the outer circumferential surface of the small diameter portion 111*a* of the cylindrical body. These partitioned free spaces are called compression chambers 126. As described previously, the pitch of the helical blade groove 124 is gradually diminished from the lower portion toward the upper portion. It follows that the volumes of the compression chambers are gradually diminished from the lowermost compression chamber 126 toward the uppermost compression chamber 126.

On the other hand, an introducing guide port 127 is formed through the frame 111*b* of the cylindrical body. The introducing guide port 127 is formed at a position which is not exposed to the outside during the eccentric rotation of the cylinder 112.

Also, an outlet guide port 128 is formed through the closed upper wall 112*a* of the cylinder 112 so as to permit the uppermost compression chamber 126 positioned inside the closed upper wall 112*a* to communicate with the inner space of the hermetic case 101 which is positioned outside the closed upper wall 112*a* of the cylinder 112.

An oil returning hole 130 is formed through the frame 111*b* of the cylindrical body at a position which is not covered with the flange portion 112*b* even during the eccentric rotation of the cylinder 112. An oil pipe 131 is mounted to the lower end portion of the rotary shaft 102 which is dipped in the lubricant housed in the lubricant reservoir 105. Also, an oil hole 132 substantially equal in diameter to the oil pipe 131 is formed along the axis of the main shaft portion 102*a* of the rotary shaft so as to communicate with the oil pipe 131.

An oil guiding lateral hole 133 is formed to permit the intermediate portion of the oil hole 132 to communicate with the outer circumferential surface of the main shaft portion 102*a* of the rotary shaft. Also, an oil discharging lateral hole 134, which is allowed to intermittently face the oil guiding lateral hole 133 in accordance with rotation of the rotary shaft 102, is formed in the small diameter portion 111*a* of the cylindrical body to permit the outer circumferential surface of the pivotally supporting hole portion 113 to communicate with the outer circumferential surface of the small diameter portion 111*a*.

The upper end of the oil hole 132 is positioned in the vicinity of a crank hole section 116 formed in the crank section 102*b* of the rotary shaft, and an oil guide hole 135 permits the upper end of the oil hole 132 to communicate with the crank oil hole 116.

A helical oil groove 136 is formed on the outer circumferential surface of the main shaft portion 102*a* of the rotary shaft which is pivotally supported within the pivotal supporting hole section 113 of the cylindrical body. Another helical oil groove 137 is formed on the outer circumferential surface of the drive shaft 115 which is engaged with the crank hole section 116 of the rotary shaft.

Oil pumped up through the hole 132 is supplied to the oil discharging lateral hole 134 through the oil guiding lateral hole 133. When the rotary shaft 102 is rotated, and then the oil groove 136 faces the oil discharging lateral hole 134, oil is supplied into the oil groove 136.

The motor section 104 comprises a rotor 140 which is engaged with the main shaft portion 102*a* of the rotary shaft and a stator 141 positioned to face the rotor 140 with a small clearance formed between the stator 141 and the circumferential outer surface of the rotor 140. The stator 141 is engaged with the inner circumferential surface of the hermetic case 101.

If an electric power is supplied to the motor section 104, the rotor 140 and the rotary shaft 102 are rotated together in the helical blade type compressor of the construction described above. The rotating force of the rotary shaft 102 is transmitted to the cylinder 112 via the crank section 102*b* and the drive shaft 115. Since revolution of the cylinder 112 about its own axis is regulated by the revolution preventing mechanism 123, the cylinder 112 makes an eccentric rotation relative to the cylindrical body 111.

In accordance with the eccentric rotation of the cylinder 112, the sliding portion of the cylinder 112 along the outer circumferential surface of the small diameter portion 111*a* of the cylindrical body is gradually moved in the circumferential direction, with the result that the helical blade 125 is slid within the blade groove 124 in the radial direction of the small diameter portion 111*a* of the cylindrical body. In other words, the blade 125 is slid into or out of the blade groove 124 in accordance with the eccentric rotation of the cylinder 112.

By a series of these operations, a coolant gas of a low pressure is sucked from the evaporator 110 into the hermetic case 101 through the coolant suction pipe 107. As described previously, the inner space of the hermetic case 101 is partitioned by the frame 111*b* of the cylindrical body into the upper and lower chambers. Since the coolant suction pipe 107 is connected to the lower chamber, a low pressure chamber 142 filled with a low pressure gas is formed in a lower portion of the hermetic case 101.

The coolant gas filling the low pressure chamber 142 is guided through the introducing guide port 127 into the lowermost compression chamber 126. Then, the coolant gas is gradually transferred into the uppermost compression chamber 126 in accordance with the eccentric rotation of the cylinder 112.

As described previously, the volumes of the compression chambers 126 are gradually diminished from the lowermost compression chamber 126 toward the uppermost compression chamber 126. It follows that the coolant gas is gradually compressed while being transferred into the upper compression chamber 126 so as to reach a predetermined highest pressure in the uppermost compression chamber 126.

The high pressure coolant gas within the uppermost compression chamber 126 is discharged into the hermetic case 101 through the outlet guide port 128. The high pressure coolant gas released into the hermetic case 101 is filled in the upper chamber partitioned by the frame 111*b* of the cylindrical body from the lower chamber. Therefore, the upper chamber noted above is called a high pressure chamber 143.

In other words, the frame 111*b* of the cylindrical body partitions the inner space of the hermetic case 101 into the low pressure chamber 142 and the high pressure chamber 143. The motor section 104 is located within the low pressure chamber 142, with the compressing mechanism 103 being located within the high pressure chamber 143. Also, since the coolant discharge pipe 106 communicates with the high pressure chamber 143, the high pressure gas filling the high pressure chamber 143 is released through the coolant discharge pipe 106 into the condenser 108 so as to carry out the known refrigerating cycle.

In accordance with the eccentric rotation of the cylinder 112, the cylinder flange portion 112*b* is pressed against the disk-like frame 111*b* of the cylindrical body by the high pressure gas filling the high pressure chamber 143, with the result that the lower surface of the cylinder flange portion 112*b* acting as a thrust surface slides along the frame 111*b*.

Also, in accordance with rotation of the rotary shaft 102, the lubricant housed in the lubricant reservoir 105 is sucked up through the oil pipe 131 so as to be guided into the oil hole 132, etc. As a result, the lubricant is supplied into, for example, the sliding surface between the main shaft portion 102*a* of the rotary shaft and the pivotally supporting hole 113 of cylindrical body so as to guarantee the smooth movement of these parts. After the lubricating function, the lubricant is brought back again into the lubricant reservoir 105 and further circulated through the circulating passageways described above.

In the helical blade type compressor of the second embodiment described above, the cylinder 112 is rotated. Also, and the blade groove 124 with which the blade 125 is engaged is not formed in the cylinder 112. It follows that the wall thickness of the cylinder 112 can be markedly decreased as far as a sufficient mechanical strength and rigidity can be ensured. Naturally, the rotary mass is diminished so as to diminish the unbalanced mass which causes vibration.

To be more specific, even if the compressing volume of the helical blade type compressor is prominently increased, a large unbalance is unlikely to take place so as to suppress the vibration and, thus, to improve the reliability of the compressor.

In the second embodiment described above, the compressing section 103 is located in the chamber positioned above the frame 111*b* of the cylindrical body, with the motor section 104 being located in the chamber positioned below the frame 111*b*. However, it is also possible to locate the compressing section 103 below the frame 111*b* of the cylindrical body, with the motor section (not shown) being located above the frame 111*b*, as shown in FIG. 3.

Figure 3:
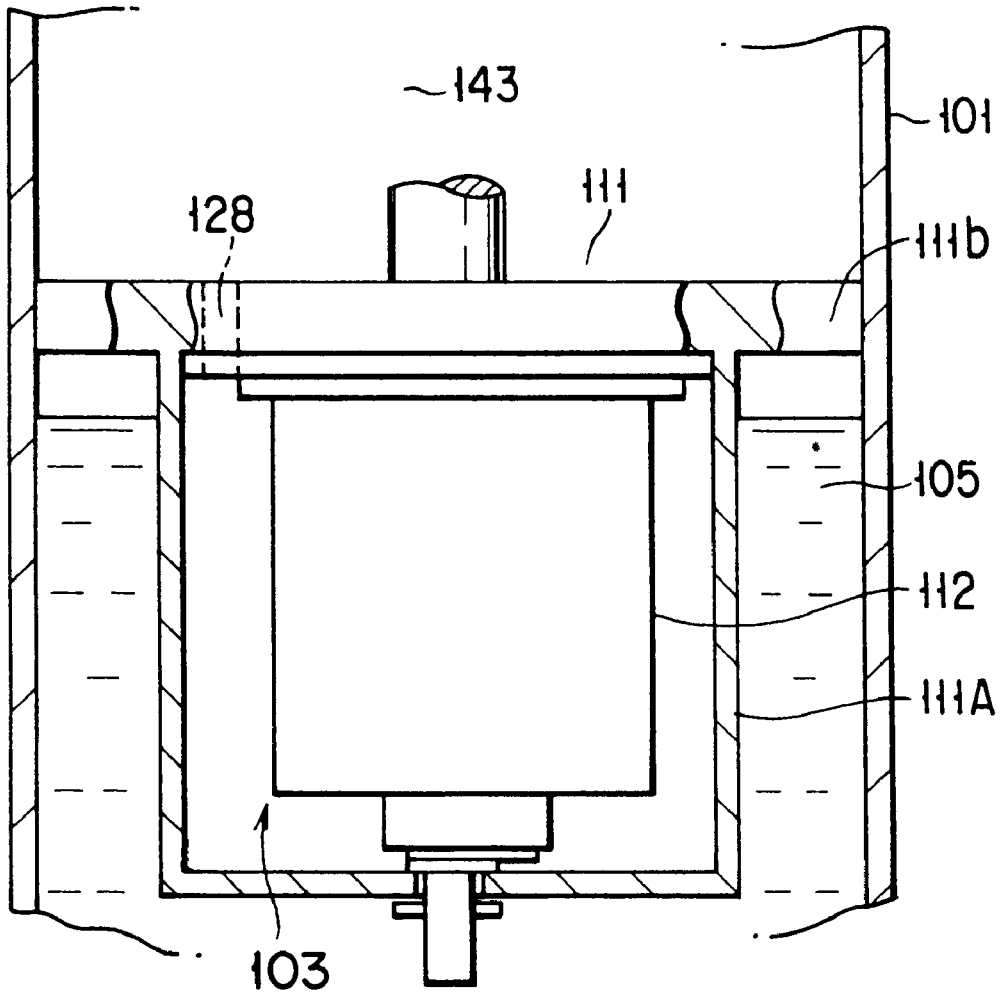
FIG. 3 is a vertical cross sectional view showing a gist portion of a modification of the helical blade type compressor shown in FIG. 2.

In the construction shown in FIG. 3, the cylinder 112 is covered with the frame 111*b* of the cylindrical body having a cylinder cover 111A formed integral with the frame 111*b*. The cylinder cover 111A, which is dipped in the lubricant housed in the lubricant reservoir 105, serves to prevent the lubricant from being stirred by the eccentric rotation of the cylinder 112 and also produces a muffler effect when the high pressure gas released through the outlet guide port 128 is guided into the high pressure chamber 143 located above the frame 111*b* without flowing through the lubricant.

Figure 4:
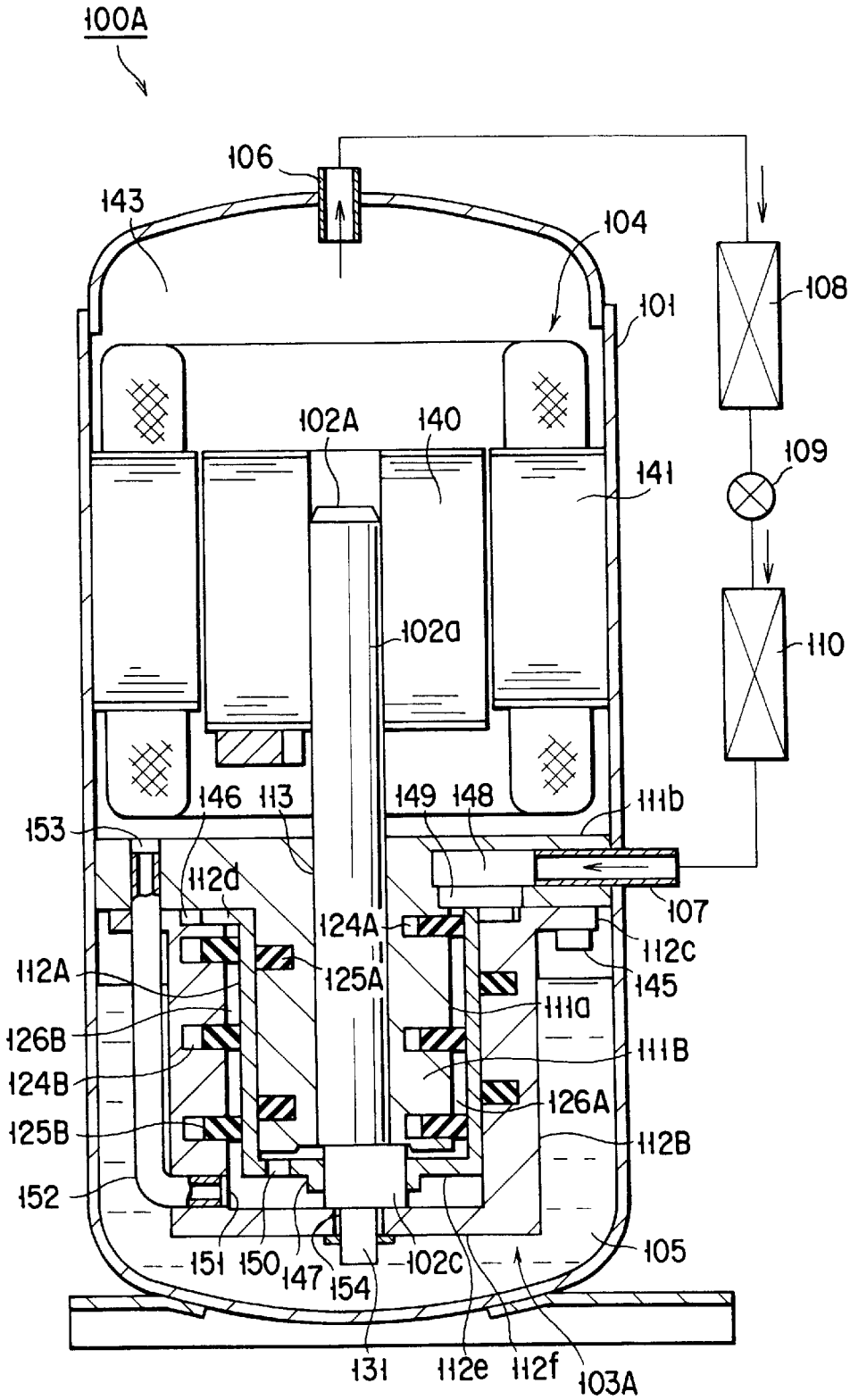
FIG. 4 is a vertical cross sectional view showing a helical blade type compressor according to a third embodiment of the present invention.

FIG. 4 is a vertical cross sectional view showing a helical blade type compressor 100A according to a third embodiment of the present invention. The helical blade type compressor of this embodiment comprises two cylinders. The reference numerals common with FIGS. 4 and 2 denote the same members of the helical blade type compressor and, thus, the explanation thereof is omitted in the following description.

As shown in FIG. 4, a compressing section 103A and a motor section 104 are arranged in a lower portion and an upper portion, respectively, of the hermetic case 101, and are joined to each other via a rotary shaft 102A. In the compressing section 103A, a main shaft portion 102*a* of the rotary shaft 102A is pivotally supported within a pivotally supporting hole 113 formed along the axis of the cylindrical body 111B.

The frame 111*b* of the cylindrical body is fixed to the inner circumferential surface of the hermetic case 101 so as to partition the inner space of the hermetic case 101 into upper and lower chambers. The small diameter portion 111*a* of the cylindrical body 111B is positioned on the lower side of the frame 111*b*, and a first blade groove 124A is formed in the circumferential surface of the small diameter portion 111*a*. The pitch of the first blade groove 124A is gradually diminished from the upper side toward the lower side, and an inside blade 125A is engaged with the first blade groove 124A.

A movable cylinder 112A is arranged to cover the circumferential and lower surfaces of the small diameter portion 111*a* of the cylindrical body, and a stationary cylinder 112B is arranged to cover the circumferential and lower surfaces of the movable cylinder 112A. In other words, the movable cylinder 112A is interposed between the cylindrical body 111B and the stationary cylinder 112B.

The upper end portion of the stationary cylinder 112B is open, and a flange portion 112C is integrally formed in the upper end portion along the outer circumferential surface of the stationary cylinder 112B. The flange portion 112*c* is fixed to the frame 111*b* of the cylindrical body with a fixing tool 145. Also, a concave thrust receiving portion 146 is formed in the upper end portion along the circumferential surface of the stationary cylinder 112B. An engaging flange portion 112*d*, which is formed in the upper open end portion along the circumferential surface of the movable cylinder 112A, is engaged with the concave thrust receiving portion 146. The flange portion 112*d* does not completely encircle the cylinder 112. Thus, in a position not shown (e.g., on the far side of the cylindrical body 111B), the suction guide portion 149 is provided to communicate with the outer compression chamber 126B.

A crank section 102*c* is mounted to the lower end of the main shaft portion 102*a* of the rotary shaft. The axis of the crank section 102*c* is deviant from the axis of the main shaft portion 102*a* of the rotary shaft. The crank section 102*c* is rotatably pivoted to a bearing section 147 mounted at the lower closed surface 112*e* of the movable cylinder 112A.

A mechanism (not shown) for regulating the revolution of the movable cylinder 112A about its own axis while allowing rotation of the movable cylinder 112A is mounted between the movable cylinder 112A and the cylindrical body 111B or between the movable cylinder 112A and the stationary cylinder 112B.

It should be noted that the rotating force of the rotary shaft 102 is transmitted to the movable cylinder 112A via the crank section 102*c* so as to allow the movable cylinder 112A to make an eccentric rotation. During the eccentric rotation of the movable cylinder 112A, the inner circumferential surface of the movable cylinder 112A is partially brought into contact with the small diameter portion 111*a* of the cylindrical body 11lB. At the same time, that portion of the outer circumferential surface of the movable cylinder 112A which is 180° apart from the contact point between the movable cylinder 112A and the cylindrical body 111B is partially brought into contact with the inner circumferential surface of the stationary cylinder 112B.

A second blade groove 124B is formed in the inner circumferential surface of the stationary cylinder 112B. An outside blade 125B is engaged with the second blade groove 124B. The pitch of the second blade groove 124B is also gradually diminished from the upper portion toward the lower portion like the first blade groove 124A. Also, these first and second blade grooves 124A and 124B are designed equal to each other in the pitch or helical angle.

An inside compression chamber 126A is defined by the small diameter portion 111*a* of the cylindrical body, the movable cylinder 112A and the inner blade 125A. Likewise, an outside compression chamber 126B is defined by the movable cylinder 112A, the stationary cylinder 112B and the outer blade 125B.

A coolant suction pipe 107 extends through the hermetic case 101 and is inserted into a guide hole 148 extending from the circumferential surface of the frame 111*b* of the cylindrical body toward the axis of the hermetic case 101. A clearance is provided between the inserted end of the coolant suction pipe 107 and the deepest portion of the guide hole 148. Also, a suction guide port 149 is provided in a manner to communicate with the clearance noted above, the inner compression chamber 126A and the outer compression chamber 126B.

An outlet guide port 150 is formed at the lower closed surface 112*e* of the movable cylinder 112A. Also, a first outlet guide hole 151 is formed through the lower circumferential wall of the stationary cylinder 112B. One end portion of an outlet guide pipe 152 is mounted to the first outlet guide hole 151.

The outlet guide pipe 152 is bent in an L-shape such that the other end portion of the outlet guide pipe 152 is mounted to a second outlet guide hole 153 extending through the frame 111*b* of the cylindrical body and the mounting flange portion 112*c* of the stationary cylinder. It follows that the outside compression chamber 126B is allowed to communicate with the inner space of the hermetic case 101 above the frame 111*b* of the cylindrical body via the outlet guide pipe 152.

A lubricant pipe 131 extends downward from the lower surface of the crank section 102*c* of the rotary shaft to project through a hole 154 formed in a lower closed wall 112*f* of the stationary cylinder 112B. A lubricant guide path (not shown) communicating with the lubricant pipe 131 is formed within the rotary shaft 102A such that the lubricant within a lubricant reservoir 105 is sucked through the lubricant guide path so as to be supplied into each of the sliding portions of the compressor in accordance with rotation of the rotary shaft 102A.

A coolant discharge pipe 106 is connected to an upper end portion of the hermetic case 101. Also, a condenser 108, an expansion valve 109 and an evaporator 110 are interposed in the order mentioned between the coolant discharge pipe 106 and the coolant suction pipe 107 so as to form a refrigerating cycle.

On the other hand, the motor section 104 comprises a rotor 140 mounted to the rotary shaft 102A and a stator 141 mounted to the inner circumferential surface of the hermetic case 101 in a manner to face the outer circumferential surface of the rotor 140 with a small clearance formed therebetween.

If an electric power is supplied to the motor section 104 to rotate the rotary shaft 102A, the crank section 102*c* of the rotary shaft 102A makes an eccentric rotation so as to cause the movable cylinder 112A to make an eccentric rotation. During the eccentric rotation of the movable cylinder 112A, the inner and outer circumferential surfaces, which are 180° apart from each other, of the movable cylinder 112A are allowed to slide along the circumferential surface of the small diameter portion 111*a* of the cylindrical body and the inner circumferential surface of the stationary cylinder 112B, respectively, with the result that the inside and outside compression chambers 126A and 126B, which are formed by the presence of the inner and outer blades 125A and 125B, respectively, are positioned deviant from each other by 180°.

A coolant gas of a low pressure generated from the evaporator 110 is sucked through the coolant suction pipe 107 into the compressor so as to be supplied directly into the inside compression chamber 126A and the outside compression chamber 126B through the suction guide port 149.

The movable cylinder 112A is constructed to permit the low pressure coolant gas to be supplied into the inside compression chamber 126A and the outside compression chamber 126B alternately. In addition, the first and second blade grooves 124A and 124B are made equal to each other in the pitch or the helical angle. It follows that the inside compression chamber 126A and the outside compression chamber 126B are made equal to each other in the suction amount of the coolant gas.

The low pressure coolant gas is gradually compressed during flow from the uppermost portion toward the lowermost portion of each of the compression chambers 126A and 126B so as to reach a predetermined high pressure in the lowermost compression chambers 126A and 126B. The high pressure gas within the lowermost inside compression chamber 126A is discharged to the outside of the movable cylinder 112A through the outlet guide port 150 so as to be combined with the high pressure gas discharged from the lowermost outside compression chamber 126B.

The combined high pressure gas is guided into the outlet guide pipe 152 so as to be discharged through the open end of the guide pipe 152 into a high pressure chamber 143 positioned above the frame 111*b* of the cylindrical body. The high pressure gas filling the high pressure chamber 143 is discharged through the coolant discharge pipe 106 so as to be guided into the condenser 108, thereby constituting a refrigerating cycle.

The helical blade type compressor of the construction described above makes it possible to obtain a large coolant gas compression capacity, which is substantially equal to that of a so-called two cylinder type compressor, without remarkably increasing the volume of the hermetic case 101. In addition, the thickness in the wall of the movable cylinder 112A can be decreased in principle. It follows that the rotary mass is not increased so as to suppress generation of vibration.

Figure 5:
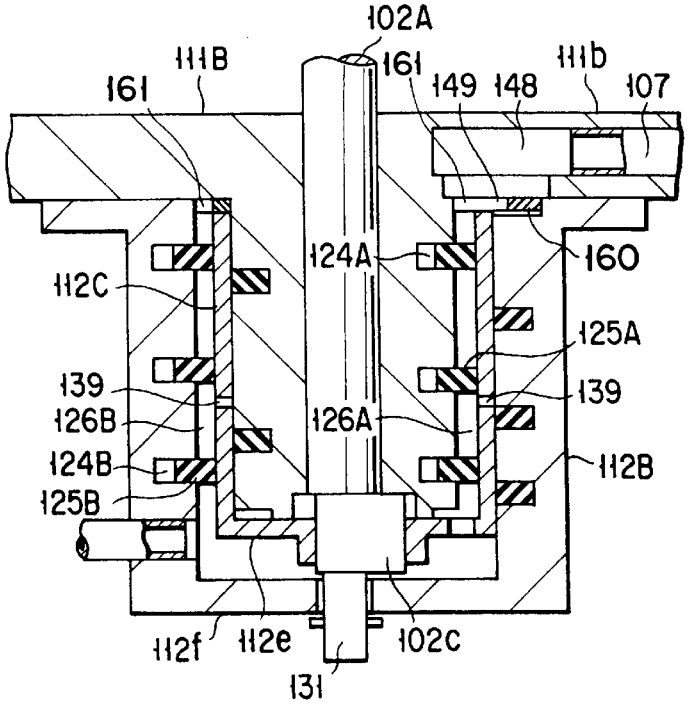
FIG. 5 is a vertical cross sectional view showing a gist portion of a modification of the helical blade type compressor shown in FIG. 4.

FIG. 5 shows a modification of the helical blade type compressor shown in FIG. 4. The reference numerals common with FIGS. 4 and 5 denote the same members of the compressor and, thus, the explanation thereof is omitted in the following description. In the modification shown in FIG. 5, a movable cylinder 112C is interposed between the cylindrical body 111B and the stationary cylinder 112B so as to make an eccentric rotation.

It suffices for the upper end portion of the movable cylinder 112C to be simply open. Therefore, it suffices to mount the suction guide port 149 alone in the upper open end of the movable cylinder 112C so as to facilitate the manufacture of the compressor and to reduce the material cost of the parts of the compressor, compared with the compressor shown in FIG. 4.

The open end acting as a gas inlet portion of the movable cylinder 112C is surrounded by the stationary cylinder 112B and is on the low pressure side. Therefore, a gas leakage does not take place.

It should also be noted that a thrust receiving section 160 of the movable cylinder 112C is formed in each of the open end of the movable cylinder 112 and the lower end of the cylindrical body 111B so as to guarantee a smooth eccentric rotation of the movable cylinder 112C. The thrust receiving section 160 keeps constant the distance between the movable cylinder 112C and the cylinder body 111, and enables the movable cylinder to be smoothly moved. A hole 161 is formed in part of the thrust receiving section 160 to ensure the gas flow between the suction guide port 149 and the inner compression chamber 126A and outer compression chamber 126B.

Since the open end of the movable cylinder 112C permits the inside compression chamber 126A to communicate with the outside compression chamber 126B, it is possible to increase the sucking efficiency of the coolant gas. Also, a plurality of balancing holes 139 are formed through the circumferential wall of the movable cylinder 112C so as to permit the inside compression chamber 126A and the outside compression chamber 126B to communicate with each other. It follows that, when the coolant gas within one of the inside and outside compression chambers is in an excessively compressed state, the coolant gas is released to the other compression chamber so as to permit the coolant gas pressures within the inside and outside compression chambers to be substantially equal to each other.

In the embodiments described above, the blade grooves 124A, 124B are formed in the movable cylinders 112A to 112C. However, the present invention is not limited to the particular construction. In other words, the blade groove can be formed elsewhere, as shown in FIGS. 6 to 9.

Figure 6:
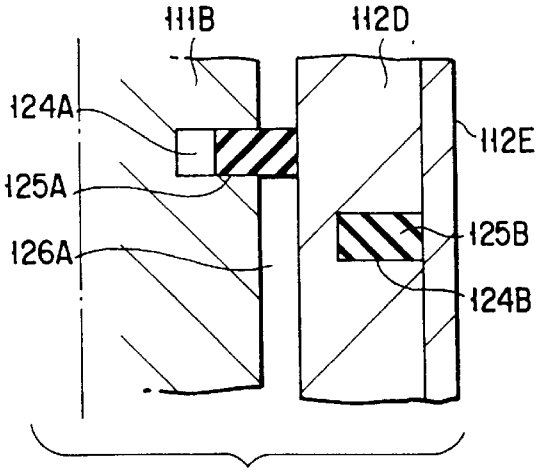
FIG. 6 is a vertical cross sectional view showing a gist portion of a modification of the helical blade type compressor shown in FIG. 4.

Specifically, in a modification shown in FIG. 6, the blade groove 124A with which the inner blade 125A is engaged is formed on the circumferential surface of the small diameter portion 111B of the cylindrical body. However, the blade groove 124B with which the outer blade 125B is engaged is formed on the outer circumferential surface of a movable cylinder 112D. It follows that, since a blade groove need not be formed in a stationary cylinder 112E, the wall thickness of the stationary cylinder 112E can be decreased. It should also be noted that, since the blade groove 124B is formed on the outer circumferential surface of the movable cylinder 112D, the blade groove 124B can be formed easily, compared with the case where the blade groove 124B is formed on the inner circumferential surface of the stationary cylinder 112B as described previously with reference to FIGS. 4 and 5, leading to reduction in the number of required process steps.

Figure 7:
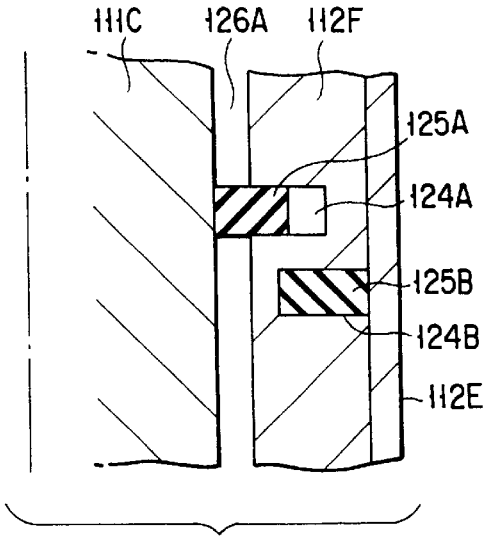
FIG. 7 is a vertical cross sectional view showing a gist portion of a modification of the helical blade type compressor shown in FIG. 4.

In the modification shown in FIG. 7, any of the cylindrical body 111C and the stationary cylinder 112E is not provided with a blade groove. Also, the first blade groove 124A with which the inner blade 125A is engaged is formed on the inner circumferential surface of a movable cylinder 112F, and the second blade groove 124B with which the outer blade 125B is engaged is formed on the outer circumferential surface of the movable cylinder 112F. In this modification, the phases of the first and second blade grooves 124A and 124B are deviated from each other to prevent these blade grooves from interfering with each other on the inner and outer circumferential surfaces of the movable cylinder 112F, quite naturally. As a result, the wall thickness of the movable cylinder 112F is made larger than that in the modification described previously. However, since the two blade grooves 124A and 124B are formed in the movable cylinder 112F, an adverse effect given by an increase in weight can be greatly suppressed so as to inhibit an increase in the rotary mass.

Figure 8:
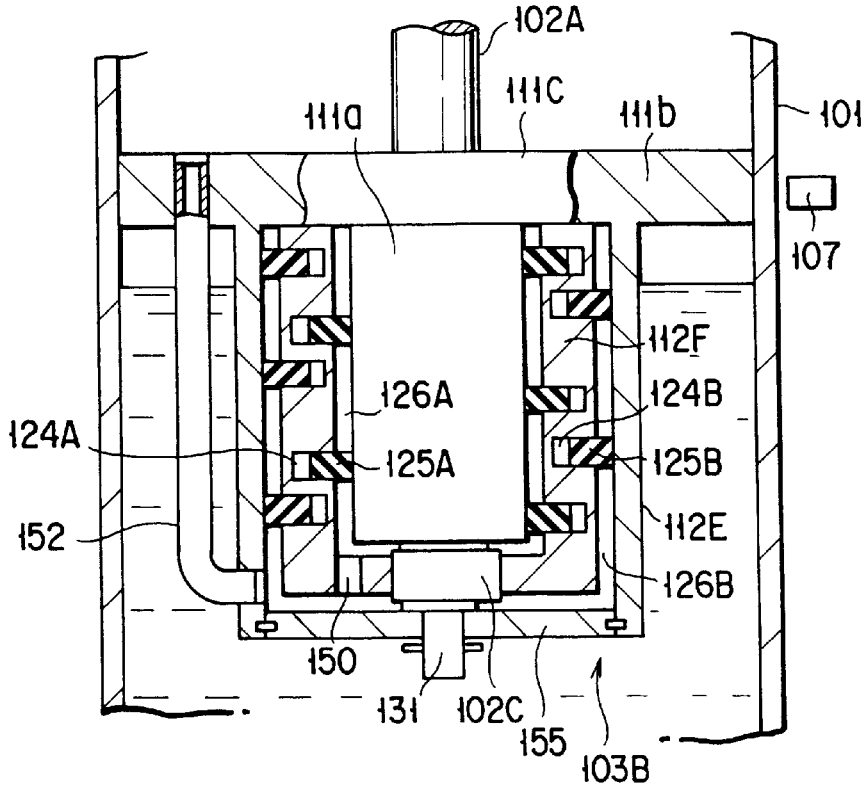
FIG. 8 is a vertical cross sectional view showing a gist portion of a modification of the helical blade type compressor shown in FIG. 4.

FIG. 8 shows the entire compressing section 103B including the movable cylinder 112F provided with the first and second blade grooves 124A, 124B. The members of the compressor common with those described previously are denoted by the same reference numerals so as to omit explanation thereof in the following description.

In the modification shown in FIG. 8, the thickness of the stationary cylinder 112E can be decreased. Also, since a blade groove is not formed in any of the cylindrical body 111C and the stationary cylinder 112E, these cylindrical body 111C and the stationary cylinder 112E can be formed integrally, and a concentric processing can be applied thereto so as to maintain a high precision. In this case, the lower end of the stationary cylinder 112E is open unavoidably. However, it suffices to provide a lid 155 to close the open lower end.

Figure 9:
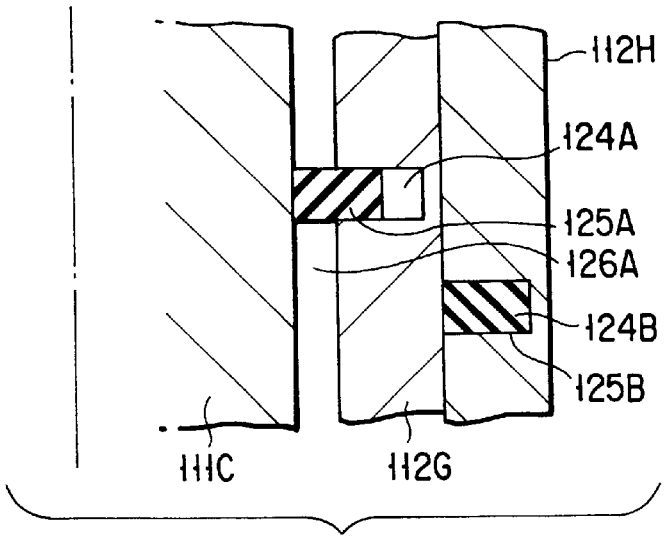
FIG. 9 is a vertical cross sectional view showing a gist portion of a modification of the helical blade type compressor shown in FIG. 4.
Figure 10:
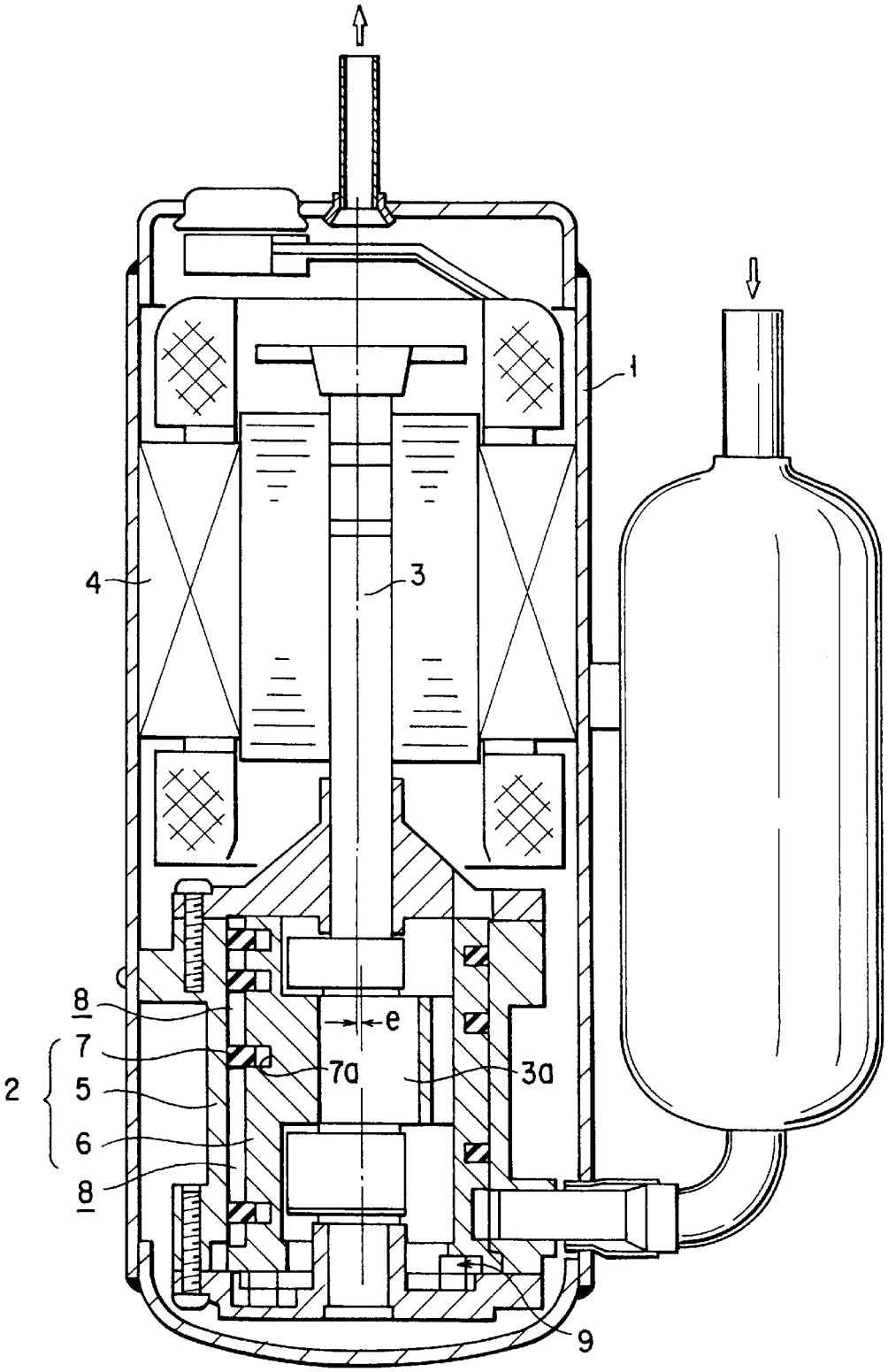
FIG. 10 (PRIOR ART)
FIG. 10 is a vertical cross sectional view showing a conventional helical blade type compressor.

Further, in the modification shown in FIG. 9, the first blade groove 125A with which the inner blade 124A is engaged is formed on the inner circumferential surface of a movable cylinder 112G. Also, the second blade groove 125B with which the outer blade 124B is engaged is formed on the inner circumferential surface of a stationary cylinder 112H. In this modification, the movable cylinder 112G and the stationary cylinder 112H are substantially prevented from being increased in wall thickness and in weight.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A helical blade type compressor, comprising:

a stationary cylindrical body;

a cylinder closed at one end, open at another end, and arranged to surround an outer circumferential surface of the cylindrical body;

a helical blade interposed between the outer circumferential surface of the cylindrical body and an inner circumferential surface of the cylinder; and a compression chamber defined among the outer circumferential surface of the cylindrical body, the inner circumferential surface of the cylinder, and the helical blade, wherein an object fluid is guided into the compression chamber so as to be compressed in accordance with eccentric rotation of the cylinder relative to the cylindrical body.

2. The helical blade type compressor according to claim 1, wherein the cylindrical body pivotally supports a rotary shaft extending through both end portions of the cylindrical body and having an end portion joined to the cylinder, the cylinder being eccentrically rotated by rotating the rotary shaft.

3. The helical blade type compressor according to claim 2, wherein the rotary shaft is provided with an eccentric crank hole portion, a drive shaft engaged with said crank hole portion is formed in the closed end of the cylinder, and the cylinder is eccentrically rotated via the crank hole portion and the drive shaft in accordance with rotation of the rotary shaft.

4. The helical blade type compressor according to claim 2, wherein the rotary shaft is provided with a crank portion, a bearing section pivotally supporting the crank portion is integrally formed in the closed end of the cylinder, and the cylinder is eccentrically rotated via the crank portion and the bearing section in accordance with rotation of the rotary shaft.

5. The helical blade type compressor according to claim 1, wherein a compressing section is formed of the cylindrical body, the cylinder and the blade, the compressing section is housed within a case, a frame is integrally mounted to the cylindrical body, and the frame is fixed to the case.

6. The helical blade type compressor according to claim 5, wherein the frame partitions the inner space of the case into a high pressure chamber and a low pressure chamber.

7. The helical blade type compressor according to claim 6, wherein the compressing section consisting of the cylindrical body, the cylinder and the blade is arranged within the high pressure chamber within the case, a flange portion is formed along the circumferential surface on the open end side of the cylinder, and the flange portion forms a thrust surface.

8. The helical blade type compressor according to claim 6, wherein the compressing section consisting of the cylindrical body and the blade is arranged within the low pressure chamber within the case, and the cylinder is covered with a cylinder cover.

9. A helical blade type compressor, comprising:

a stationary cylindrical body;

a movable cylinder closed at one end, open at another end, and arranged to surround an outer circumferential surface of the cylindrical body;

stationary cylinder closed at one end, open at another end, and arranged to surround an outer circumferential surface of the movable cylinder;

a helical inner blade interposed between the outer circumferential surface of the cylindrical body and an inner circumferential surface of the movable cylinder;

an inner compression chamber defined among the outer circumferential surface of the cylindrical body, the inner circumferential surface of the movable cylinder and the inner blade;

an helical outer blade interposed between the outer circumferential surface of the movable cylinder and an inner circumferential surface of the stationary cylinder; and an outer compression chamber defined among the outer circumferential surface of the movable cylinder, the inner circumferential surface of the stationary cylinder, and the helical outer blade, wherein an object fluid is guided into each of the inner compression chamber and the outer compression chamber so as to be compressed in accordance with the eccentric rotation of the movable cylinder relative to the cylindrical body.

10. The helical blade type compressor according to claim 9, wherein:

the cylindrical body pivotally supports a rotary shaft extending through both end portions of the cylindrical body;

the rotary shaft is provided with an eccentric crank portion;

a bearing section pivotally supporting the eccentric crank portion is integrally formed in the closed end of the cylinder; and the movable cylinder is eccentrically rotated via the eccentric crank portion and the bearing section in accordance with the rotation of the rotary shaft.

11. The helical blade type compressor according to claim 9, wherein the inner blade and the outer blade are arranged about 180° deviant from each other.

12. The helical blade type compressor according to claim 9, wherein the inner blade and the outer blade are formed equal to each other in pitch or helical angle to permit an object fluid to be supplied into the inside compression chamber and the outside compression chamber in the same amount.

13. The helical blade type compressor according to claim 9, wherein the movable cylinder is provided with a balancing hole portion communicating with the inside compression chamber and with the outside compression chamber.

14. The helical blade type compressor according to claim 9, wherein an upper surface of the cylindrical body or the closed end of the movable cylinder forms a thrust surface.

15. The helical blade type compressor according to claim 9, wherein the inner blade is engaged with a blade groove formed on the outer circumferential surface of the cylindrical body, and the outer blade is engaged with a blade groove formed on the inner circumferential surface of the stationary cylinder.

16. The helical blade type compressor according to claim 9, wherein the inner blade is engaged with a blade groove formed on the outer circumferential surface of the cylindrical body, and the outer blade is engaged with a blade groove formed on the outer circumferential surface of the movable cylinder.

17. The helical blade type compressor according to claim 9, wherein the inner blade is engaged with a blade groove formed on the inner circumferential surface of the movable cylinder, and the outer blade is engaged with a blade groove formed on the outer circumferential surface of the movable cylinder.

18. The helical blade type compressor according to claim 14, wherein the inner blade is engaged with a blade groove formed on the inner circumferential surface of the movable cylinder, and the outer blade is engaged with a blade groove formed on the inner circumferential surface of the stationary cylinder.

* * * * *